US008905262B2

(12) United States Patent
Shull

(10) Patent No.: US 8,905,262 B2
(45) Date of Patent: Dec. 9, 2014

(54) COMBINED CONTAINER HOLDER OPENER AND CAP

(71) Applicant: Michael Shull, Evansville, IN (US)

(72) Inventor: Michael Shull, Evansville, IN (US)

( * ) Notice: Subject to any disclaimer, the term of this patent is extended or adjusted under 35 U.S.C. 154(b) by 0 days.

(21) Appl. No.: 13/767,485

(22) Filed: Feb. 14, 2013

(65) Prior Publication Data

US 2014/0224796 A1 Aug. 14, 2014

(51) Int. Cl.

| | |
|---|---|
| ***A47G 23/03*** | (2006.01) |
| ***B65D 25/28*** | (2006.01) |
| ***B65D 51/00*** | (2006.01) |
| *A47G 19/22* | (2006.01) |

(52) U.S. Cl.

CPC ..... *B65D 25/2832* (2013.01); *B65D 51/007* (2013.01)

USPC ..... 220/737; 220/741

(58) Field of Classification Search

USPC ..... 220/740, 737, 741, 742

See application file for complete search history.

(56) References Cited

U.S. PATENT DOCUMENTS

| | | | | | |
|---|---|---|---|---|---|
| 2,088,387 | A | * | 7/1937 | Rice, Jr. et al. | 215/395 |
| 2,784,578 | A | * | 3/1957 | Southwick | 220/741 |
| 2,801,743 | A | * | 8/1957 | Geen | 206/434 |
| 2,813,742 | A | * | 11/1957 | Neugebauer | 248/145.6 |
| 3,719,305 | A | * | 3/1973 | Pressnell | 220/740 |
| 4,120,073 | A | * | 10/1978 | Studebaker | 294/33 |
| 4,602,723 | A | * | 7/1986 | DeMars | 220/742 |
| 4,817,810 | A | * | 4/1989 | Shull | 220/741 |
| 4,898,297 | A | * | 2/1990 | Wheeler | 220/742 |
| 5,013,074 | A | * | 5/1991 | Galle | 294/33 |
| 5,054,638 | A | * | 10/1991 | Rose | 220/759 |
| 5,582,321 | A | * | 12/1996 | Urbanczyk | 220/739 |
| 7,207,538 | B2 | * | 4/2007 | Kent-Fawkes | 248/311.2 |

* cited by examiner

*Primary Examiner* — Mickey Yu
*Assistant Examiner* — Niki Eloshway
(74) *Attorney, Agent, or Firm* — Gary K Price

(57) ABSTRACT

A combined container holder opener and cap, having an end portion with at least a pair of locking tabs. Holding the holder container in a first position the end portion serves as a base for holding a beverage container in drinking mode, and holding the holder container in a second, inverted position the end portion is a cap for holding the beverage container in capped mode.

11 Claims, 3 Drawing Sheets

COMBINED CONTAINER HOLDER OPENER AND CAP

CROSS REFERENCES TO RELATED APPLICATIONS

U.S. Provisional Application for Patent No. 61/599,139, filed Feb. 15, 2012 which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates to a container holder for holding cans, such as the type containing beverages, and including a releasable locking cap for the open container.

2. Brief Description of Prior Art

Containers such as that disclosed in U.S. Pat. No. 4,817,810 entitled combined container holder and opener is known in the art for use with containers or cans, such as those containing beverages. As disclosed, the holder can include a body onto which the beverage container is disposed, and an opener for opening the beverage container having the pull-up tab. However, once the beverage container has been opened, the prior art holders fail to include means for capping unfinished drinks full of carbonation in order to help seal in freshness, and/or to serve as a shield to prevent bugs from entering.

The present invention overcomes the preceding problems and/or undesirable results by providing a combined container holder and opener that includes a cap in order to keep the soda carbonated, spill proof, and also serve as a bug shield.

SUMMARY OF THE INVENTION

A combined container holder opener and cap, having an end portion with at least a pair of locking tabs. Holding the holder container in a first position the end portion serves as a base for holding a beverage container, in drinking mode and holding the holder container in a second, inverted position the end portion is a cap, for holding the beverage container in capped mode.

DESCRIPTION OF THE PREFERRED EMBODIMENT

In accordance with the present invention, a combined container holder opener and cap is disclosed. Briefly stated, the present invention is directed to a container holder having a drinking mode and a capped mode to preserve flavor and also serve as a bug shield. In the broadest context, the combined container holder opener and cap disclosed herein consists of components configured with respect to each other so as to attain the desired objective.

Figure 1:
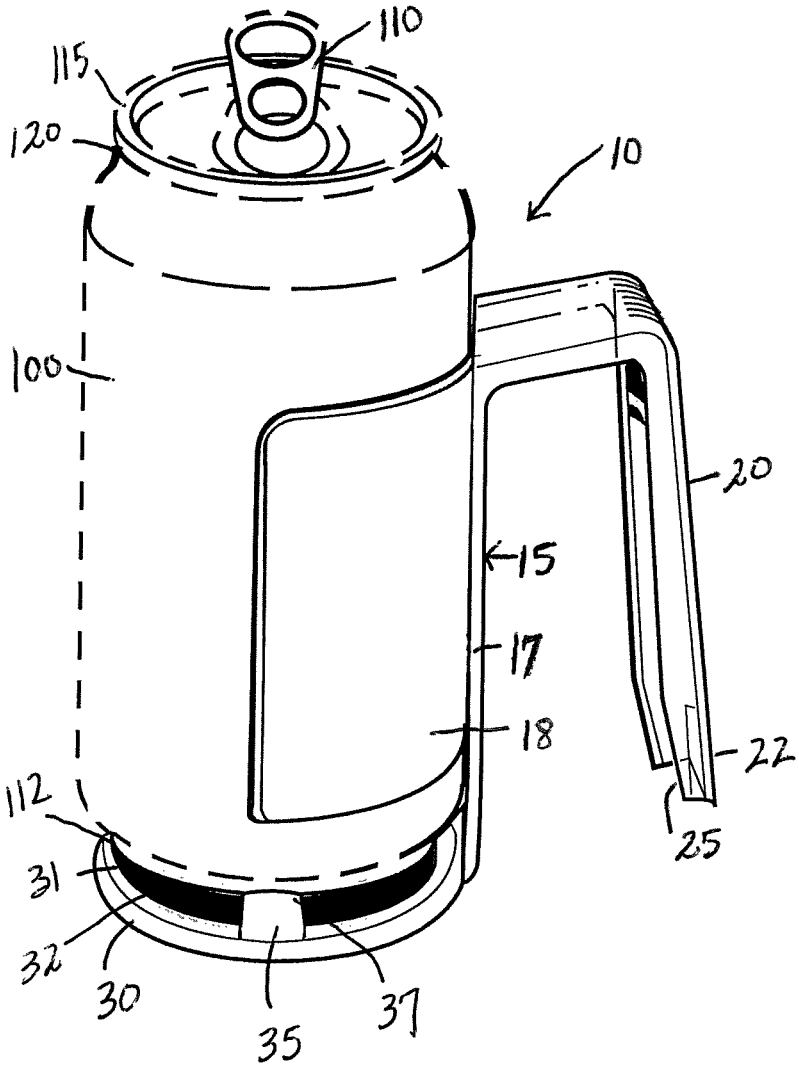
FIG. 1 is a front view of the preferred embodiment of the present invention, a combined container holder opener and cap, holding a beverage container or can in a drinking mode or first position.
Figure 2:
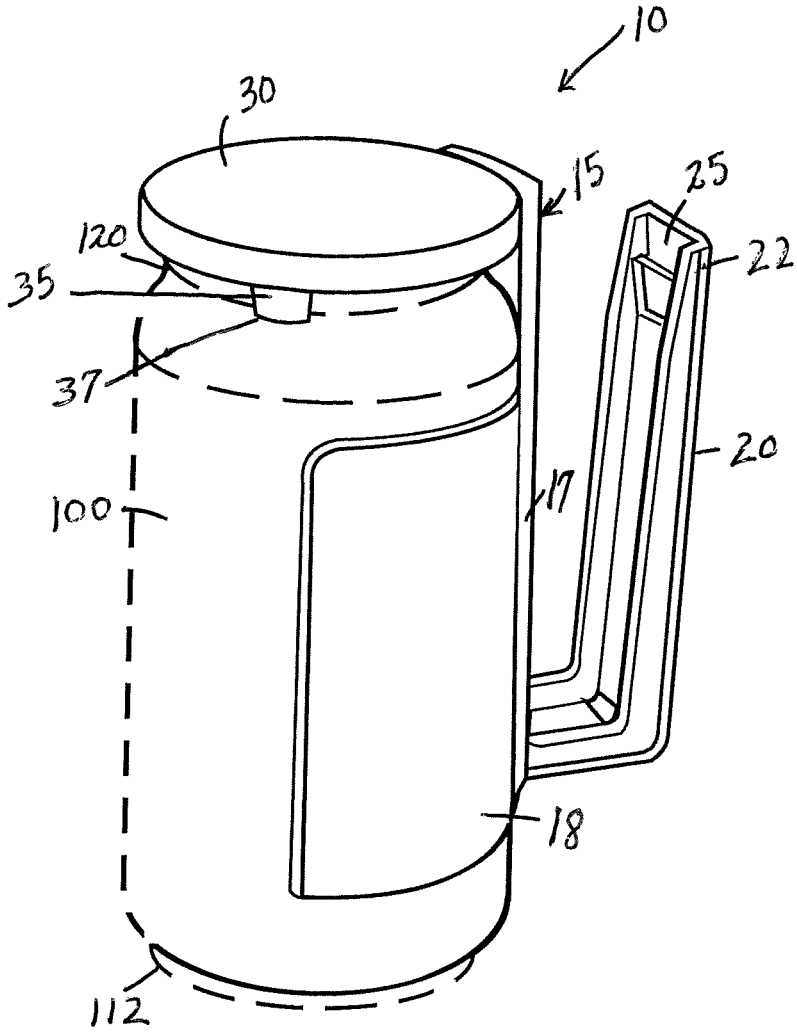
FIG. 2 is a front view of the container holder illustrated in FIG. 1, holding a beverage container in capped mode or second position.

Referring to FIGS. 1 and 2, the combined container holder opener and cap is disclosed. The container holder, designated as numeral 10, generally includes a holder portion 15 that defines an upstanding side wall 17 that includes an arm portion 20 that outwardly extends from the upstanding side wall 17 and assists in holding the beverage container 100 (shown in phantom).

As illustrated, an end portion 22 of the arm portion 20 includes a distal end having an open cavity 25 (FIG. 2) for opening a pull-tab 110 of the beverage container 100. As is known, movement of the tab 110 may either serve to reveal the opening to the beverage container 100 by pulling action for complete removal or by rotating the cover operated by the tab 110 into the beverage container 100. In any event, with application of the means 25 in the arm portion 20, the beverage container 100 is open so that the contents thereof can be poured.

As shown in the drawings, the upstanding side wall 17 includes a wall portion 18 that preferably partially encircles the carried beverage container 100 in order to assist in the holding and opening of the beverage container 100.

Figure 3:
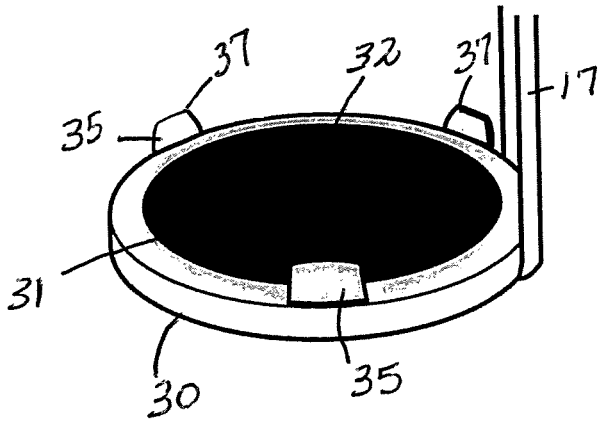
FIG. 3 is a perspective view of the end portion of the container holder illustrated in FIGS. 1 and 2.

The container 10 further includes an end portion 30 (see also FIG. 3) wherein when the holder container 10 is in the drinking mode as shown in FIG. 1, the opened beverage container 100 is placed for holding. In the preferred embodiment, the end portion 30 defines a centrally disposed cavity 31 for receiving an absorbent member 32 which in application in drinking mode, the absorbent member 32 is sandwiched between the end portion 30 and a base or bottom end 112 of the beverage container 100, such that the bottom end 112 rests on the absorbent member 32. The absorbent member 32 for absorbing any condensation or moisture from the beverage container 100 while being held.

FIG. 2 shows the holder container 10 in the capped mode for storing an opened beverage container 100. In the capped mode, the holder container 10 is invented such that the end portion 30 is now a cap for the beverage container 100, that in application, and as illustrated in FIG. 2, releasably snaps to a top portion 115 of the beverage container 100. More particularly, the end portion 30 includes at least a pair of locking tabs 35. The locking tabs 35 each having a lip portion 37 for releasably attaching to a top rim 120 of the beverage can 100.

As should be understood, when in drinking mode (FIG. 1), the holder container 10 is inverted such that the end portion 30 serves as a base or bottom for holding the beverage container 100, and the holder container 10 can be used as a holder and opener for the beverage can 100. As illustrated further, in drinking mode, the arm portion 20 extends outward and downward from the side wall 17 such that the end portion 22 of the arm 20 is adjacent the end portion 30.

In the capped mode (FIG. 2), the user simply inverts the holder 10 as shown in FIG. 2, such that the end portion 30 is now a cap for top portion 115 of the beverage container 100. The locking tabs 35 of the end portion 30 releasably attach to the top rim 120 of the beverage can 100. In the capped mode, the end portion 30 helps keep the soda carbonated, can prevent the can drink from spilling, and the cap 30 further prevents bugs from crawling into the drink at for example, picnics. As illustrated further, in the capped mode, the arm portion 20 extends outward and upward from the side wall 17 such that the end portion 22 of the arm 20 is adjacent the end portion 30.

Although the description above contains many specificities, these should not be construed as limiting the scope of the invention but is merely providing illustrations of some of the presently preferred embodiments of this invention. Thus the scope of the invention should be determined by the appended claims in the formal application and their legal equivalence, rather than by the examples given.

I claim:

1. A combined holder, opener and cap for a beverage container, said combined holder, opener and cap comprising:

a body that includes an upstanding side wall for at least partially surrounding the outside of a beverage container, an arm that outwardly extends from said wall, an end portion having a top surface that defines a centrally disposed cavity for receiving an absorbent member, wherein said end portion further includes at least a pair of locking tabs disposed on an outer edge of said top surface, wherein an outer edge of said absorbent member is radially spaced from said outer edge of said to surface, said locking tabs each defining a lip portion for releasably attaching said end portion to a top rim of the beverage container, and wherein a top surface of said absorbent member and said top surface of said end portion define a planar surface, and wherein said locking tabs extend upwardly from the outer edge and said lip portion extends radially inwardly, said combined holder, opener and cap having a first position wherein a bottom end of the beverage container rests on said planar surface, and a second position wherein a top of said beverage container is in communication with said planar surface.

2. The combined holder, opener and cap of claim 1, wherein in said first position said arm extends outward and downward from said wall, and wherein in said second position said arm extends outward and upward from said wall.

3. The combined holder, opener and cap of claim 2, wherein said arm defines a distal end that is adjacent said end portion.

4. The combined holder, opener and cap of claim 3, wherein said distal end having an open cavity adapted for receiving an opening tab for the beverage container.

5. The combined holder, opener and cap of claim 4, wherein in the second position, said at least a pair of locking tabs are releasably attached to the top rim of the beverage container.

6. A combined holder, opener and cap for a beverage container comprising:

a framework that includes an upstanding side wall that partially surrounds the outside of a beverage container, an arm that extends from said side wall, an end portion having a top surface, an absorbent member attached to said top surface, wherein an outer edge of said absorbent member is radially spaced from an outer edge of said top surface, at least a pair of locking tabs attached to said outer edge of said top surface, said locking tabs each defining a lip portion for releasably attaching said end portion to a top rim of the beverage container, wherein said locking tabs extend upwardly from the outer edge and the lip extends radially inwardly, and wherein a top surface of said absorbent member and said top surface of said end portion define a planar surface for communications with an end of the beverage container.

7. The combined holder, opener and cap as recited in claim 6, wherein said top end portion defining a cavity for receiving said absorbent member.

8. The combined holder, opener and cap of claim 6, wherein said combined holder, opener and cap define a first position and a second position, wherein in said first position said arm extends outward and downward from said side wall, and wherein in said position said arm extends outward and upward from said side wall.

9. The combined holder, opener and cap as recited in claim 8, wherein said arm defines a distal end.

10. The combined holder, opener and cap as recited in claim 9, wherein said distal end having means for receiving an opening tab for the beverage container.

11. The combined holder, opener and cap as recited in claim 10, wherein in said first position a bottom end of the beverage container rests on said planar surface, and in said second position said at least a pair of locking tabs are releasably attached to a top rim of the beverage container.

* * * * *